US009570245B2

(12) United States Patent
Noda et al.

(10) Patent No.: US 9,570,245 B2
(45) Date of Patent: Feb. 14, 2017

(54) METHOD FOR PRODUCING ELECTRODE MATERIAL FOR VACUUM CIRCUIT BREAKER, ELECTRODE MATERIAL FOR VACUUM CIRCUIT BREAKER AND ELECTRODE FOR VACUUM CIRCUIT BREAKER

(71) Applicant: Meidensha Corporation, Shinagawa-ku, Tokyo (JP)

(72) Inventors: Yasushi Noda, Fuji (JP); Hiromasa Sato, Odawara (JP)

(73) Assignee: Meidensha Corporation, Tokyo (JP)

( * ) Notice: Subject to any disclaimer, the term of this patent is extended or adjusted under 35 U.S.C. 154(b) by 0 days.

(21) Appl. No.: 14/659,706

(22) Filed: Mar. 17, 2015

(65) Prior Publication Data

US 2015/0200059 A1 Jul. 16, 2015

Related U.S. Application Data

(62) Division of application No. 13/806,568, filed as application No. PCT/JP2011/064608 on Jun. 20, 2011, now Pat. No. 9,281,136.

(30) Foreign Application Priority Data

Jun. 24, 2010 (JP) ..... 2010-143243
Dec. 21, 2010 (JP) ..... 2010-284649

(51) Int. Cl.
*H01H 1/02* (2006.01)
*B22F 3/26* (2006.01)
(Continued)

(52) U.S. Cl.
CPC ..... *H01H 1/0206* (2013.01); *B22F 3/26* (2013.01); *C22C 1/0425* (2013.01);
(Continued)

(58) Field of Classification Search
CPC .... H01H 1/0206; H01H 33/6642; H01H 1/06; C22C 1/0425; H01B 13/0036; H01B 1/02; B22F 2998/10; B22F 1/0003; B22F 3/02; B22F 3/10; B22F 3/26
(Continued)

(56) References Cited

U.S. PATENT DOCUMENTS 5,557,083 A 9/1996 Komuro et al.
6,479,779 B1 * 11/2002 Falkingham ..... H01H 33/6642 218/123
(Continued)

FOREIGN PATENT DOCUMENTS

EP 0 634 766 A2 1/1995
JP 7-29461 A 1/1995
(Continued)

OTHER PUBLICATIONS

Corresponding International Search Report with English Translation dated Sep. 27, 2011 ( four (4) pages).
(Continued)

*Primary Examiner* — Edwin A. Leon
(74) *Attorney, Agent, or Firm* — Crowell & Moring LLP

(57) ABSTRACT

Provided are a method for producing an electrode material for a vacuum circuit breaker, whereby withstand voltage, high current interruption performance and capacitor switching performance can be improved; an electrode material for a vacuum circuit breaker; and an electrode for a vacuum circuit breaker. A contact material for an electrode for a vacuum circuit breaker has an integral structure consisting of a central member and a Cu—Cr outer peripheral member, the central member having been produced as described above and comprising 30 to 50 wt % of Cu of a particle diameter of 20 to 150 μm and 50 to 70 wt % of Mo—Cr of a particle diameter of 1 to 5 μm, while the outer peripheral
(Continued)

member being formed of a material, which is highly compatible with the central member, shows excellent interruption performance and had high withstand voltage, and being provided outside the central member and fixed thereto.

4 Claims, 5 Drawing Sheets

(51) Int. Cl.

| | |
|---|---|
| ***C22C 1/04*** | (2006.01) |
| ***C22C 9/00*** | (2006.01) |
| ***C22C 27/04*** | (2006.01) |
| ***C22C 30/02*** | (2006.01) |
| ***H01B 1/02*** | (2006.01) |
| ***H01B 13/00*** | (2006.01) |
| ***H01H 1/06*** | (2006.01) |
| *H01H 33/664* | (2006.01) |

(52) U.S. Cl.
CPC ..... *C22C 1/0491* (2013.01); *C22C 9/00* (2013.01); *C22C 27/04* (2013.01); *C22C 30/02* (2013.01); *H01B 1/02* (2013.01); *H01B 13/0036* (2013.01); *H01H 1/06* (2013.01); *B22F 2998/10* (2013.01); *H01H 33/6642* (2013.01)

(58) Field of Classification Search
USPC ..... 200/265; 218/132
See application file for complete search history.

(56) References Cited

U.S. PATENT DOCUMENTS

| | | | | |
|---|---|---|---|---|
| 6,551,374 | B2 | 4/2003 | Doh et al. | |
| 6,649,855 | B2 * | 11/2003 | Nishijima | H01H 33/6642 218/123 |
| 6,765,168 | B2 * | 7/2004 | Takebuchi | H01H 33/6642 218/118 |
| 2002/0068004 | A1 | 6/2002 | Doh et al. | |
| 2011/0220613 | A1 | 9/2011 | Matsui | |

FOREIGN PATENT DOCUMENTS

| | | | |
|---|---|---|---|
| JP | 2002-15644 | A | 1/2002 |
| JP | 2002-180150 | A | 6/2002 |
| JP | 2003-92050 | A | 3/2003 |
| JP | 3926994 | B2 | 6/2007 |
| JP | 2010-113821 | A | 5/2010 |

OTHER PUBLICATIONS

International Preliminary Report on Patentability (PCT/IB/338 & PCT/IB/373), including Written Opinion (PCT/ISA/237) dated Jan. 24, 2013 with English translation (nine (9) pages).

* cited by examiner

METHOD FOR PRODUCING ELECTRODE MATERIAL FOR VACUUM CIRCUIT BREAKER, ELECTRODE MATERIAL FOR VACUUM CIRCUIT BREAKER AND ELECTRODE FOR VACUUM CIRCUIT BREAKER

CROSS REFERENCE TO RELATED APPLICATIONS

This application is a continuation of U.S. application Ser. No. 13/806,568, filed Dec. 20, 2012, which claims the priority from Japanese Patent Application No. 2010-284649, filed Dec. 21, 2010 and 2010-143243, filed Jun. 24, 2010, the disclosures of which are expressly incorporated by reference herein.

BACKGROUND OF THE INVENTION

The present invention relates to a method for producing an electrode material for vacuum circuit breaker, an electrode material for vacuum circuit breaker, and an electrode for circuit breaker. The invention relates particularly to a method for producing an electrode material of an alloy of molybdenum (Mo)-chromium (Cr) for a vacuum circuit breaker of high-voltage with large capacity that has a good interruption performance.

A vacuum circuit breaker has a cylindrical insulative container of ceramic that is capable of maintaining its inside vacuum. The container arranges two electrodes facing each other in a coaxial arrangement. One electrode works as a fixed side electrode and the other works as a moving side electrode. The container and the electrodes so arranged compose the main body of a circuit breaking valve in the vacuum circuit breaker. The circuit breaking valve interrupts current by movement of the electrodes, wherein the electrode on the moving side is moved toward circuit-opening direction by an operating mechanism installed in the vicinity of the main body of the valve.

As Japanese Laid-open Patent Application No. 2003-92050 (Patent literature 1) and Japanese Laid-open Patent Application No. 2010-113821 (Patent literature 2) for example describe, electrodes in vacuum circuit breakers of recent days have such structure that each of those electrodes, on the fixed side and the moving side, generates an axial magnetic field when arcing occurs. When such electrode of the moving side moves to open the circuit, the electrodes, i.e., the fixed side electrode and the moving side electrode, separate and stay at the redetermined separation position to disperse the arc appeared across the electrodes in the circuit-open position by the axial magnetic field making it possible to interrupt high currents.

Each electrode of axial magnetic field type is comprised of a cup-shaped contact member fixed on the end face of a conductive rod and a contact plate as an arcing portion, is firmly fixed on the end face of the conductive rod. The outer periphery of the cup-shaped contact member, which outer peripheral part is on the opposite side of the conductive rod, has a plurality of slits that are slant with respect to the axis. These slits in such configuration form a plurality of current paths namely what is called a coil portion. When the electrode of axial magnetic field type on the moving side is moved toward circuit-opening direction, use of such cup-shaped contact member causes the current flowing through the coil portion to generate the axial magnetic field; thereby arc ignited on the contact plate is dispersed and the current is interrupted.

In a vacuum circuit breaker of high-voltage with large capacity, each electrode of axial magnetic field type thereof, which repeats movements for contacting and separating, uses material with a good electrical performance in such as the current interruption performance and the withstand voltage performance as the electrode material for the contact plate that works as the contact face. In general, electrode materials for vacuum circuit breakers are sintered compacts manufactured by a method comprising: mixing copper (Cu), as a material having good conductivity, and such as Cr or Mo, as an arc-resistant component, at a predetermined ratio to obtain a mixture; pressing and molding the mixture; and sintering the press-molded mixture in a non-oxygen atmosphere such as vacuum.

For example, Japanese Patent Gazette No. 3926994 (Patent literature 3) has proposed an electrode material of sintered compact, wherein, in manufacturing a Cu—Cr based material as an electrode material with good electrical performance in such as the current interruption and the withstand voltage performance, the sintered compact is obtained by processing a mixture of Cu, as the base material, and Cr, as the electrical performance improving constituent, and heat resisting elements that makes Cr particles fine.

The specified range of composition of the proposed electrode material is, in terms of weight ratio, Cu 20 to 80%, Cr 10 to 80%, Mo 0.001 to 80%, tungsten (W) 0.01 to 80%, tantalum (Ta) 0.001 to 80%, niobium (Nb) 0.001 to 80%, and vanadium (V) 0.001 to 80%.

Japanese Laid-open Patent Application No. 2002-15644 (Patent literature 4) proposes a highly reliable contact material for a vacuum circuit breaker in which welding and wear of the contact material is little and arcing resistance performance is improved and contact resistance is low. The proposed contact material contains a highly electro-conductive component composed of at least one kind of Cu, silver (Ag), and gold (Au) whose content is from 20 to 45 wt %, and an arc-resistant component composed of at least one kind of W, Mo whose content is from 55 to 80 wt %. The literature further describes such a feature that metal texture of this contact material has a scatter of the highly electro-conductive phase having a maximum cross-sectional area sized from 0.001 to 0.005 $mm^2$. The literature also proposes a processing in which the highly electro-conductive component is infiltrated into holes in a sintered compact at the final stage of the manufacturing.

As Patent literature 3 mentioned above describes, to improve electrical performance of an electrode material for vacuum circuit breaker in such as the current interruption performance against fault currents (hereinafter referred to as "high current interruption performance") and withstand voltage performance, it is effective to increase content amount of high melting point materials such as Cr and Mo in the Cu substrate of Cu-based electrode material, and to use Cr, etc. having fine grain size, and to disperse them homogeneously. However, excessive increase in content amount of high melting point materials such as Cr and Mo decreases the content amount of Cu in the electrode material for vacuum circuit breaker. This causes the conductivity of the material to be lowered and consequently the contact resistance increases with the high current interruption performance lowered. Further, such excessive increase invites a disadvantage in that the interruption performance in the cutting-off of capacitive loads (hereinafter referred to as "capacitor switching performance") will be not satisfied. Moreover, as Patent literature 4 describes, the high current interruption performance or the capacitor switching performance is lowered in particular for the electrode material of Cu—W system that is manufactured by mixing Cu powder and W powder; this prevents the material from being applied to vacuum circuit breakers.

It is well known that the content of high melting point material such as Cr in an electrode material for a vacuum circuit breaker for high-voltage with large capacity needs to be increased. However on the other hand, there has been a problem with such electrode material in that the increased amount lowers the high current interruption performance and increases the contact resistance.

Moreover, when the impulse voltage (hereinafter abbreviated as "IMP" for short) property of the contact plate of the electrode at the time of the current interruption of a vacuum circuit breaker is examined, it is revealed that electric field intensity around the periphery of the contact plate at the time of arcing is high causing concentration of electric field, which will easily develop to an IMP withstand voltage breakdown. For this reason, in the vacuum circuit breaker that uses an electrode of axial magnetic field type, improvement in IMP withstand voltage of the contact plate and more improvement in the high current interruption performance and the capacitor switching performance are desired.

In addition, when the contact plate is formed using a material such that Cu is infiltrated into Mo—Cr alloy with content amount of Mo increased, the electron emission due to the electric field will increase and discharge due to IMP will occur in the intense electric field area, incurring a disadvantage of the withstand voltage against IMP being lowered. Moreover, when the contact plate of the electrode of axial magnetic field type is formed using only Cu—Cr alloy of a good IMP performance having increased content amount of high melting point material such as Cr, the high current interception performance and the capacitor switching performance will be lowered.

An object of the present invention is to provide a method for producing an electrode material for vacuum circuit breaker and an electrode material for vacuum circuit breaker, wherein the electrode material is capable of improving the withstand voltage, the high current interruption performance, and the capacitor switching performance even if the content amount of the arc-resistant component in the electrode material is increased.

Another object of the present invention is to provide an electrode for vacuum circuit breaker that is capable of improving IMP withstand voltage together with improving the high current interruption performance and the capacitor switching performance.

BRIEF SUMMARY OF THE INVENTION

A method for producing an electrode material for vacuum circuit breaker by the present invention is comprised of the steps of: mixing Mo powder having a particle diameter of 0.8 to 6 μm with a thermite Cr powder having a particle diameter of 40 to 300 μm homogeneously in such a manner as giving a mixing ratio (Mo:Cr) of 1:1 to 9:1 and satisfying the weight relation Mo≥Cr; press-sintering wherein the resultant mixture is pressure molded under a press pressure of 1 to 4 t/cm2 to give a molded article, which is sintered by being maintained at a temperature of 1100 to 1200° C. for 1 to 2 hours to form a partially sintered article; and infiltrating Cu into the partially sintered article obtained in the press-sintering step by placing a thin Cu plate on the partially sintered article and maintaining them at a temperature of 1100 to 1200° C. for 1 to 2 hours so that Cu is liquid-phase sintered and infiltrated into the partially sintered article.

An electrode material for vacuum circuit breaker thus produced is comprised of 30 to 50 wt % of Cu having a particle diameter of 20 to 150 μm, and 50 to 70 wt % of Mo—Cr having a particle diameter of 1 to 5 μm.

The electrode material for vacuum circuit breaker by the present invention is comprised of a cup-shaped contact member fixed on the end face of a conductive rod and a contact plate as an arcing portion, firmly fixed on the end face of the cup-shaped contact member, wherein the outer periphery of one end of the cup-shaped contact member has a plurality of slits that are slant with respect to the axis forming a axial magnetic field type configuration, wherein the contact plate has an integrated one-body construction comprised of a central member and an outer peripheral member that is fixed firmly on the outer periphery of the central member, wherein the central member includes 30 to 50 wt % of Cu having a particle diameter of 20 to 150 μm and 50 to 70 wt % of Mo—Cr having a particle diameter of 1 to 5 μm and the outer peripheral member is a Cu—Cr material highly compatible with the central member and is made of a high withstand voltage material having an excellent interruption performance.

It is preferable that the outer peripheral member is formed annularly using sintered alloy and that the central member is formed in a disk-like shape using sintered alloy. It is also preferable that the central member has such a configuration that a circular copper plate is firmly fixed on the cup-shaped contact member side and that the outer peripheral member is formed in a disk-like shape of hollow surface using a material of high withstand voltage, wherein the central member made of a material having high current interruption performance is arranged in the recessed portion of the hollow surface of the outer peripheral member.

The method for producing the electrode material for vacuum circuit breaker by the present invention is comprised of the steps: mixing Mo powder and thermite Cr powder homogeneously at a mixing ratio of Mo:Cr=1:1 to 9:1 and satisfying the weight relation Mo≥Cr, pressure molding the resultant mixture under the specified press pressure to form a molded article, sintering the molded article to form a partially sintered article, and heating the sintered article with a thin Cu plate placed thereon to infiltrate Cu into the partially sintered article by the liquid-phase sintering. Therefore, with this method, electrode material can be produced easily.

Further, the electrode material has a texture in which Cu is infiltrated into the Mo—Cr alloy of fine matrix with a homogeneous distribution. This feature gives the electrode material a higher hardness with more improved arc resistivity than conventional materials. Thereby, increasing in the contact resistance is suppressed and the electrical performance in such as the high current interruption performance and the withstand voltage performance, which are requirements of vacuum circuit breakers, will improve; further, the capacitor switching performance will also be improved.

In the electrode for vacuum circuit breaker by the present invention, the contact plate is comprised of the central member located in the center of the electrode, wherein the central member includes 30 to 50 wt % of Cu having a particle diameter of 20 to 150 μm and 50 to 70 wt % of Mo—Cr having a particle diameter of 1 to 5 μm. This configuration improves the high current interruption performance and the capacitor switching performance. Further, since the contact plate is formed on the outer periphery of the electrode using the outer peripheral member of Cu—Cr material, IMP withstand voltage is improved more than that in the conventional art. Moreover, when both the outer peripheral member and the central member, which are constituents of the contact plate, are formed using sintered alloy, the producing thereof will be easy and the electrode of axial magnetic field type will be produced economically.

EMBODIMENT 1

Figure 1:
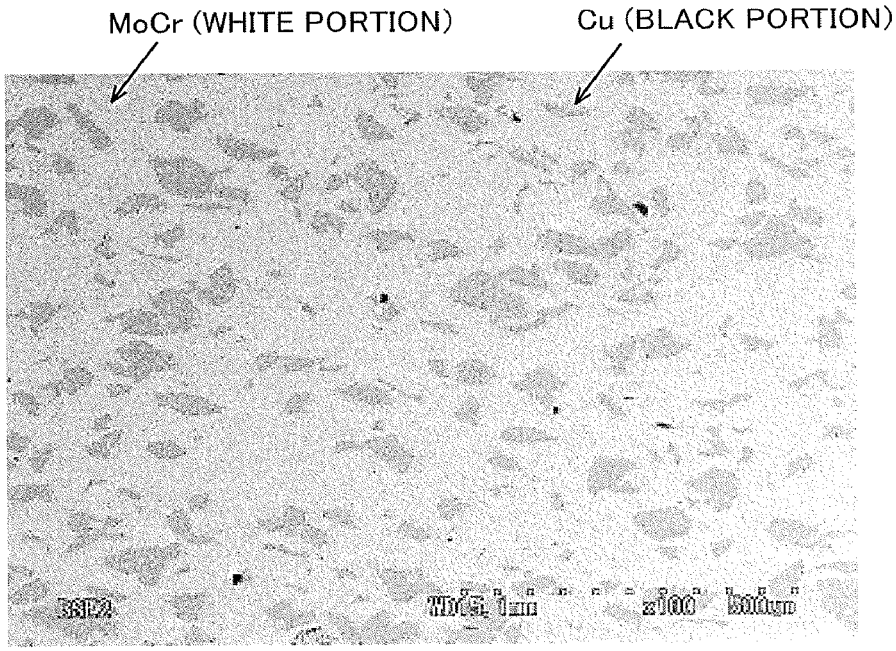
FIG. 1 is a micrograph of metal texture of the electrode material produced by the method for producing electrode material for vacuum circuit breaker by the present invention.

The following explains the method for producing electrode material for vacuum circuit breaker and then the electrode material for vacuum circuit breaker. The producing of the electrode material for vacuum circuit breaker uses Mo powder and Cr powder as the chief material. Mo powder used is a commercially available Mo powder having a particle diameter of 0.8 to 6 μm. Cr powder used is a thermite Cr (a metal Cr powder formed by thermite reduction) powder because an ordinary fine powder of Cr is not usable as it is easily-oxidizable. Thermite Cr powder should preferably have a particle diameter of about 40 to 80 μm; however, a commercially available powder having a particle diameter of 40 to 300 μm may be used. A commercially available thermite Cr powder is usable because the oxygen content of such thermite Cr powder is 500 to 1200 ppm, not over 1200 ppm.

Mo powder and a thermite Cr powder are, as is detailed later, mixed together homogeneously at a mixing ratio of 1:1 or over, that is Mo:Cr=1:1 to 9:1, and satisfying the weight relation Mo≥Cr. According to the examination of an embodiment example, which is be mentioned later, preferable mixing ratio of Mo—Cr is about 3:1. Whatever the mixing ratio is, existence of Cr, which works as an arc-resistant component, of about 5 to 15 wt % improves the high current interruption performance and the capacitor switching performance. Therefore, it becomes more suitable as an electrode material for a vacuum breaker.

The method for producing the electrode material for vacuum circuit breaker by the present invention is comprised of the steps: mixing Mo powder and thermite Cr powder homogeneously, pressure molding the resultant mixture under the specified press pressure to form a molded article, press-sintering the molded article by heating to a specified temperature to form a partially sintered article; infiltrating Cu into the partially sintered article obtained in the press-sintering step by placing a thin Cu plate on the partially sintered article and heating them to a predetermined temperature so that Cu is infiltrated into the partially sintered article.

To explain more specifically, preparing Mo powder and thermite Cr powder which fulfill the above-mentioned conditions, the first process mixes these materials homogeneously to obtain a mixture. In the subsequent process, which is the press-sintering step, the mixture is put in the metallic mold having a predetermined form and undergoes a short-time pressing at a pressure of 1 to 4 t/cm$^2$ to obtain the molded article. The molded article is sintered by being maintained at a temperature of 1100 to 1200° C. for 1 to 2 hours in a heating furnace to form a partially sintered article (skeleton) of Mo—Cr alloy.

In the final process, which is the Cu infiltrating process, the partially sintered article of Mo—Cr alloy undergoes the infiltrating process, in which a thin Cu plate, the wettability of which is highly compatible with such Mo—Cr alloy, is placed thereon and they are maintained at a temperature of 1100 to 1200° C. for 1 to 2 hours in a heating furnace for infiltration. Thereby, Cu having several tens μm of grain diameter can be infiltrated homogeneously into the fine-textured sintered base material of Mo—Cr alloy by liquid-phase sintering.

The sintering conditions, that is, the temperature is to be 1100 to 1200° C. with the retention time of 1 to 2 hours, in producing the partially sintered article can be otherwise determined for more suitable heating temperature and retention time length depending on the mixing ratio of Mo powder and thermite Cr powder. Likewise, the Cu infiltration conditions, that is, the temperature is to be 1100 to 1200° C. with the retention time being 1 to 2 hours, can be otherwise properly determined for more suitable heating temperature and retention time length depending on the degree of Cu infiltration.

(Embodiment Example of Electrode Material for Vacuum Circuit Breaker and Comparison Example)

Table 1 lists embodiment examples and a comparison example. The embodiment examples are electrode materials, which are listed as Samples No. 1 to No. 12, produced by the method that the present invention defines, which method is comprised of the mixing step, the press-sintering step, and the Cu infiltration step. The comparison example, which is listed as Sample No. 13, is an electrode material for vacuum circuit breaker manufactured by a conventional method using Cu—Cr as the main constituent.

TABLE 1

| Sample | Content (w/t %) | | | Mo:Cr Mixing | Compaction pressure on MoCr | Contact resistance | Brinell hardness | Evaluation |
|---|---|---|---|---|---|---|---|---|
| No. | Cu | Mo | Cr | ratio | (t/cm$^2$) | (μΩ) | (HB) | result |
| No. 1 | 40 | 45 | 15 | 3:1 | 4 | 4.5 | 260 | ◎ |
| No. 2 | 30 | 63 | 7 | 9:1 | 4 | 7.2 | 197 | ◎ |
| No. 3 | 37 | 50 | 13 | About 4:1 | 4 | 8.4 | 229 | ◎ |
| No. 4 | 41 | 45 | 14 | About 3:1 | 3 | 2.6 | 182 | ◎ |

TABLE 1-continued

| Sample No. | Content (w/t %) Cu | Mo | Cr | Mo:Cr Mixing ratio | Compaction pressure on MoCr (t/cm$^2$) | Contact resistance (μΩ) | Brinell hardness (HB) | Evaluation result |
|---|---|---|---|---|---|---|---|---|
| No. 5 | 51 | 38 | 11 | About 3:1 | 1 | 3.6 | 99 | ◎ |
| No. 6 | 34 | 33 | 33 | 1:1 | 4 | 5.2 | 179 | Δ |
| No. 7 | 41 | 30 | 29 | About 1:1 | 3 | 3.4 | 205 | Δ |
| No. 8 | 55 | 23 | 22 | About 1:1 | 1 | 3.8 | 158 | Δ |
| No. 9 | 28 | 18 | 54 | 1:3 | 4 | 8.0 | 154 | X |
| No. 10 | 36 | 16 | 48 | 1:3 | 3 | 6.0 | 191 | X |
| No. 11 | 52 | 12 | 36 | 1:3 | 1 | 4.3 | 148 | X |
| No. 12 | 59 | 31 | 10 | About 3:1 | 0 | 5.0 | 93 | X |
| No. 13 | 50 | — | 50 | — | — | 4.8 | 80 | X |

Electrode materials for vacuum circuit breakers from Samples No. 1 to No. 12 were prepared by mixing Mo—Cr homogeneously at the mixing ratio indicated in Table 1. Except Sample No. 12, the mixture thus prepared for each of Samples No. 1 to No. 11 was press-formed by compacting at pressures of 1 t/cm2 as a minimum to 4 t/cm2 as a maximum and then sintered by being maintained at a temperature of 1150° C. for 1.5 hours in a heating furnace to form a partially sintered article of Mo—Cr alloy. And then, a thin Cu plate was placed on the partially sintered article and they were maintained at a temperature of 1150° C. for 1.5 hours in a heating furnace for infiltration to disperse homogeneously Cu into Mo—Cr alloy so that Cu would be contained in each sample at the weight-% content ratio as indicated in Table 1.

Figure 2:
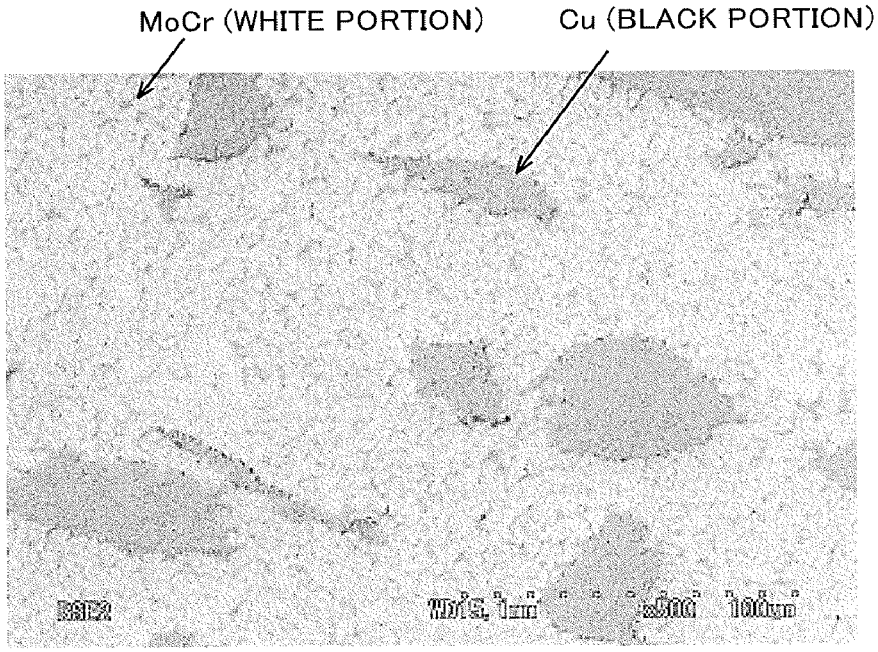
FIG. 2 is an enlarged micrograph of the object shown in FIG. 1.

The electrode material for vacuum circuit breaker produced by the method described above has such a texture that Cu having a particle diameter of 20 to 150 μm (black portion) is dispersed in the Mo—Cr alloy of fine texture having a particle diameter of 1 to 5 μm (white portion) in which Cr is diffused and firmly fixed on Mo particles, as FIG. 1 (a micrograph of 100 magnification) and FIG. 2 (a micrograph of 500 magnification) show. It is estimated that this is a result of the infiltration of Cu into the voids generated by the diffusing and firmly fixing of Cr, on which Mo particles adhere, during infiltrating.

In Samples No. 1 to No. 5 in Table 1, the mixing ratios of Mo:Cr are about 3:1, 9:1, or about 4:1; and the weights in the mixture is Mo>Cr, and the compaction pressures are different, that is, 4 t/cm2, 3 t/cm2, or 1 t/cm2. However, the contact resistances of them are lower than that of Sample No. 13, a conventional material; and the Brinell hardness of them are high. Thus, they were judged suitable (◎) for the electrode material for vacuum circuit breaker. Samples No. 6 to No. 8 are samples the mixing of which are about 1:1, wherein the compacting pressure was varied in the same manner as those described above. Contact resistances and Brinell hardness of them were judged acceptable (Δ) for using as the electrode material for vacuum circuit breakers.

However, as for electrode materials like Samples No. 9 to No. 11, the Mo:Cr mixing ratio of which is 1:3 namely the weights in the mixture is Mo<Cr, the judgments on such materials were unusable because performance were not satisfactory. Further, even for an electrode material like Sample No. 12, the Mo:Cr mixing ratio of which is 3:1 but without applying compacting pressure by a press on Mo—Cr, the judgment on such materials was unusable (x) because performance were not satisfactory.

Figure 3A:
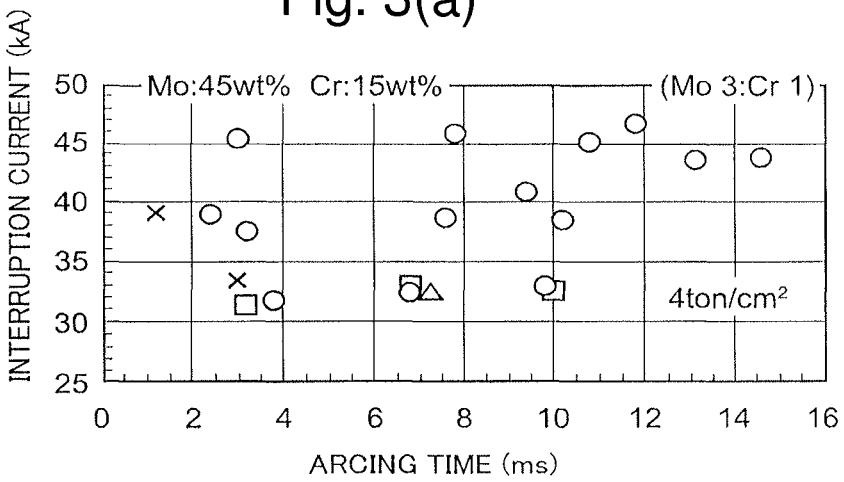
FIGS. 3(*a*), 3(*b*), 3(*c*) are charts that indicate the results of the interruption rating test of the electrode material for vacuum circuit breaker by the present invention. The results are indicated in terms of arcing time vs. interruption current for the materials of different mixing ratio of Mo—Cr.
Figure 3B:
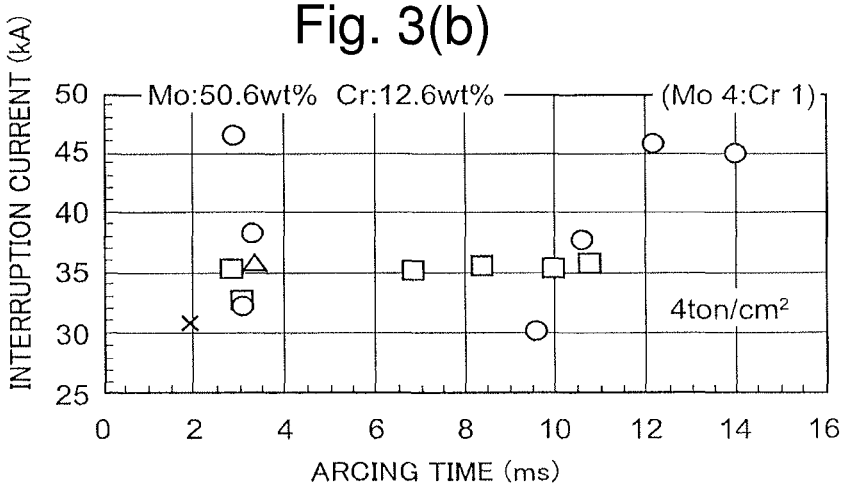
Figure 3C:
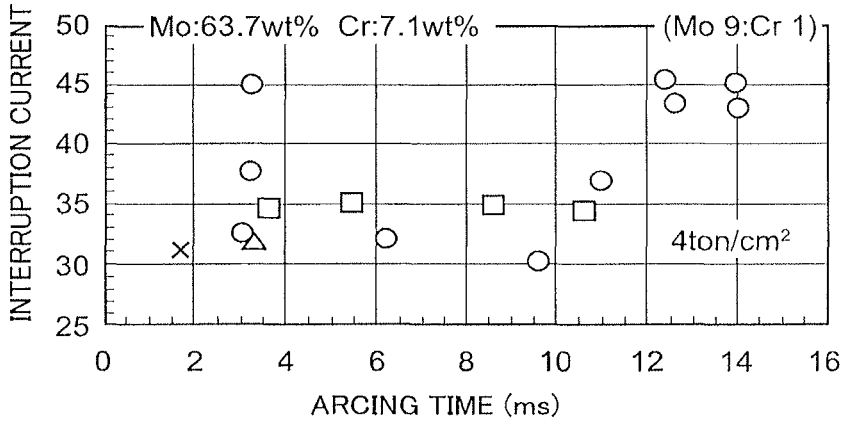

FIGS. 3(*a*) to 3(*c*) show the results of the rating test of the Cu—Cr—Mo electrode material for vacuum circuit breaker produced by the above-stated method defined in the present invention, wherein the test was performed at 36 kV with 31.5 kA. The mixing ratios of the electrode materials put under the test were as follows: 3:1 (Mo: 45 wt %, Cr: 15 wt %), 4:1 (Mo: 50.6 wt %, Cr: 12.6 wt %), and 9:1 (Mo: 63.7 wt %, Cr: 7.1 wt %). Each of them were produced by compacting pressure of 4 t/cm2. A circle in the chart represents that the test result was successful in the circuit opening (or breaking) test for examination of the performance under the conditions: closing the circuit under no-load and opening the circuit with a load connected. A square in the chart represents that the test result was successful in the circuit closing-opening test for examination of the performance under the conditions: closing the circuit with a load connected and opening the circuit with the load connected. A cross and a triangle in the chart represent that the test results in the circuit opening test and the circuit closing-opening test were not successful respectively. Where Mo content is rich, electrode materials by the present invention demonstrated successful interruption performance in the circuit opening even under a high current interruption (kA) and a long arcing time (ms) as FIGS. 3(*a*) to 3(*c*) clearly shows.

Table 2 lists the results of a test on the capacitor switching performance of the materials namely a solid phase sintered Cu—Cr material (Cu 50 wt %), which is a conventional material, and a infiltrated Cu—Cr—Mo material (Mo:Cr=3:1, compacting pressure 4 t/cm2), which is a material by the present invention. The test was conducted in the manner of the circuit opening test (indicated with "O") and the circuit closing test (indicated with "C") under such a severe testing conditions for the comparison purpose as described in the table.

TABLE 2

| | Conventional Cu—Cr material Cu—50 wt % Cr Solid-phase sintered | Invented Cu—Cr—Mo material Mo:Cr = 3:1 4 t/cm$^2$ Infiltrated |
|---|---|---|
| Count of re-arcing or re-ignition/Test count | 3/10 (Test was discontinued due to frequent re-ignition) | 1/48 |
| Probability of re-arcing or re-ignition | 30% | 2.1% |
| Testing condition | "C"-"O" "C" 55 kV/√3x√2 = 44.9 kV 4000 A-425 Hz (4.0 kA-417 Hz) "0" 55 kV//√3x 1.4 400 A | |

As Table 2 shows clearly, the probability of re-arcing or re-ignition in the conventional material was 30% because the count of the re-arcing or re-ignition/test count was 3/10 until the test was discontinued due to frequent re-ignition. In contrast to this, the probability of re-arcing or re-ignition in the material by the present invention was 2.1%, that is, the count of the re-arcing or re-ignition/test count of the material was 1/48; this means that the invented material has an excellent capacitor switching performance with very low probability of re-ignition.

In the producing method that the present invention defines, an electrode materials for vacuum circuit breaker is produced by a method in which Mo powder and thermite Cr powder are mixed and sintered to obtain Mo—Cr alloy of fine texture and Cu, the wettability of which is highly compatible with the fine alloy texture, is infiltrated into voids in the alloy. This method is capable of ensuring that the quantity of Cu in the alloy is a specified certain level by dispersing uniformly Cu having several tens μm of grain diameter in the fine-textured sintered base material of Mo—Cr alloy. Thus, in contrast to the conventional electrode material of 50-50 wt % of mixing ratio of Cu—Cr for vacuum circuit breaker, the increase in contact resistance is suppressed without lowering the interruption performance of the electrode material for vacuum circuit breaker.

Further, this electrode material for vacuum circuit breaker, though it is a Mo—Cr alloy having a composite texture that includes larger amount of the arc-resistant component, has an improved performance in the high current interruption performance because of its texture being fine. Moreover, the withstand voltage and the capacitor switching performance thereof are improved because the hardness of the contact can be enhanced.

EMBODIMENT 2

Figure 4:
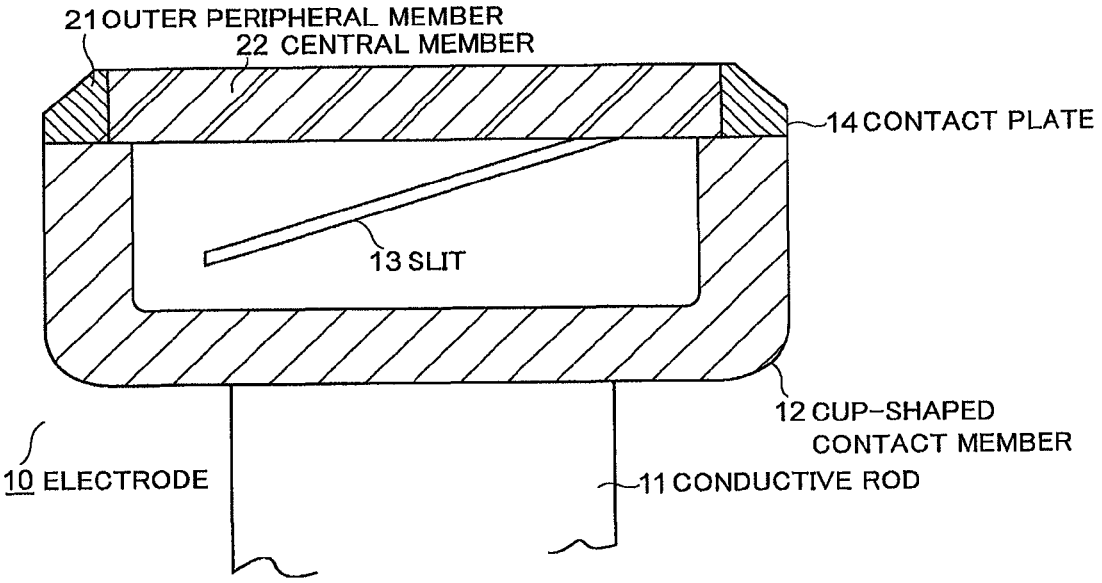
FIG. 4 is a schematic illustration of vertical cross sectional view of an embodiment of the electrode for vacuum circuit breaker by the present invention.

Next, an electrode for vacuum circuit breaker by the present invention illustrated in FIG. 4 that uses the above-stated electrode material is explained hereunder. An electrode 10 of axial magnetic field type on the fixed side or moving side has a cup-shaped contact member 12 fixed on the end of a conductive rod 11. A part of the outer periphery of the cup-shaped contact member 12, which part is on the opposite side of the conductive rod 11, has a plurality of slits 13 that are slant with respect to the axis, which form current paths as a coil portion similarly to the conventional art. On the end face of the cup-shaped contact member 12 where the slits 13 are formed, a contact plate 14 is firmly fixed. The face of the contact plate 14 contacts with another contact plate on the other electrode to flow current; on the other hand, arcing on the face of the contact plate 14 on current interruption when electrodes open the circuit.

By the present invention, the contact plate 14 is given an integrated two-parts-combined configuration. The outer portion of the plate is comprised of an outer peripheral member 21 having annular shape and the inner portion of the plate is comprised of a central member 22 having a disk-like shape; they are firmly combined to form the contact plate 14. Moreover, in such configuration, materials of the outer peripheral member 21 and the central member 22 are different. That is, the outer peripheral member 21 is produced using a high withstand voltage material with a good withstand voltage performance against IMP and the central member 22 is produced using a high current interruption capable material.

As the high withstand voltage material for producing the outer peripheral member 21, a Cu—Cr material, which is a heat resisting material, is used, wherein the Cu—Cr material is an alloy processed so that the material includes Cr in the weight ratio range between 40 wt % or more and 60 wt % or less and has a texture in which fine grained Cr is dispersed. Discharge on the contact plate 14 due to IMP occurs in the outer periphery of the plate where the electric field intensity is high. In most cases, the concentration of the electric field usually appears in the outside area off from 80% of the diameter of the contact plate 14. Therefore, the outer peripheral member 21 is produced considering these aspects. It should be noted that a stainless steel or a Cu—Cr—Mo alloy of low Mo content is also a usable material.

As the high current interruption capable material for producing the central member 22, above-stated Cu—Cr—Mo material, in which Cu is infiltrated into a fine-textured sintered alloy of Mo—Cr, is used. This Cu—Cr—Mo material is a sintered alloy obtained by mixing Mo and Cr followed by subsequent processes, wherein the mixing ratio in powder is Mo:Cr=1:1 to 9:1 and the weight relation is Mo≥Cr. The material includes 30 to 50 wt % of Cu having grain diameter of 20 to 150 μm. and 50 to 70 wt % (Mo≥Cr) of a fine-textured Mo—Cr alloy having particle diameter of 1 to 5 μm and has a high current interruption capability. The electrode 10 of axial magnetic field type is usually intended to extinguish arc by dispersing the arc to the area within about 80% of the diameter of the contact plate 14. Therefore, the central member 22 is produced to have a diameter of 70 to 80% of the diameter of the contact plate 14.

Performances of the central member 22 of the Cu—Cr—Mo material and the outer peripheral member 21 of the Cu—Cr material are such that the Cu—Cr—Mo material exceeds the Cu—Cr material in terms of the high current interruption performance and the capacitor switching performance and the Cu—Cr—Mo material is inferior to the Cu—Cr material in terms of IMP withstand voltage performance. Use of the Cu—Cr material as a high withstand voltage material and the Cu—Cr—Mo material as a high current interruption capable material are determined according to the IMP test results shown in FIG. 7 and FIG. 8.

Figure 7:
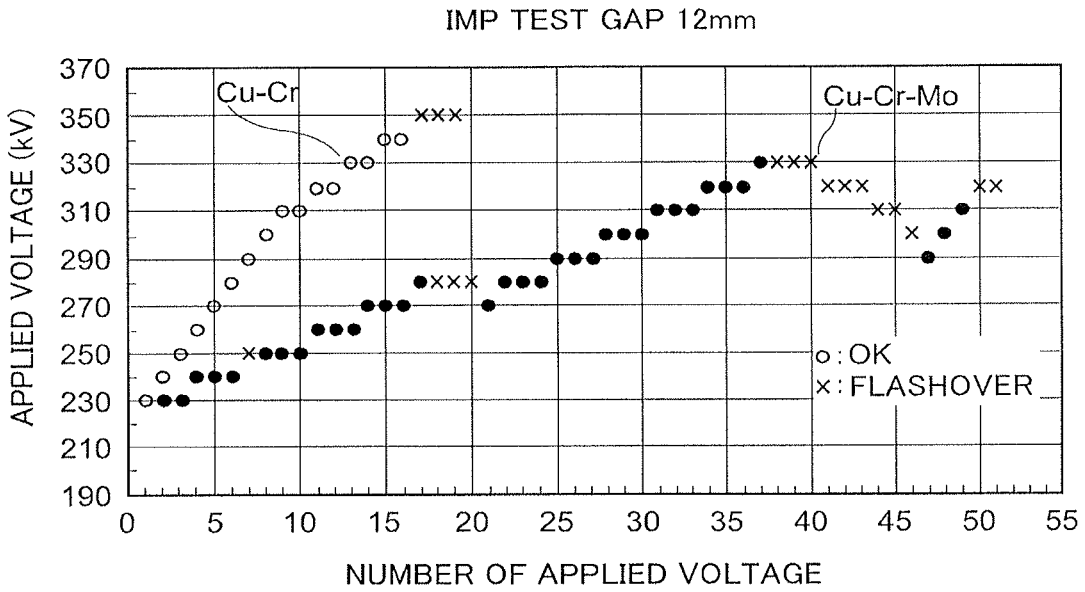
FIG. 7 is a chart that indicates the impulse voltage performance of the Cu—Cr material and the Cu—Cr—Mo material when the electrode separation of the electrode for vacuum circuit breaker is 12 mm.
Figure 8:
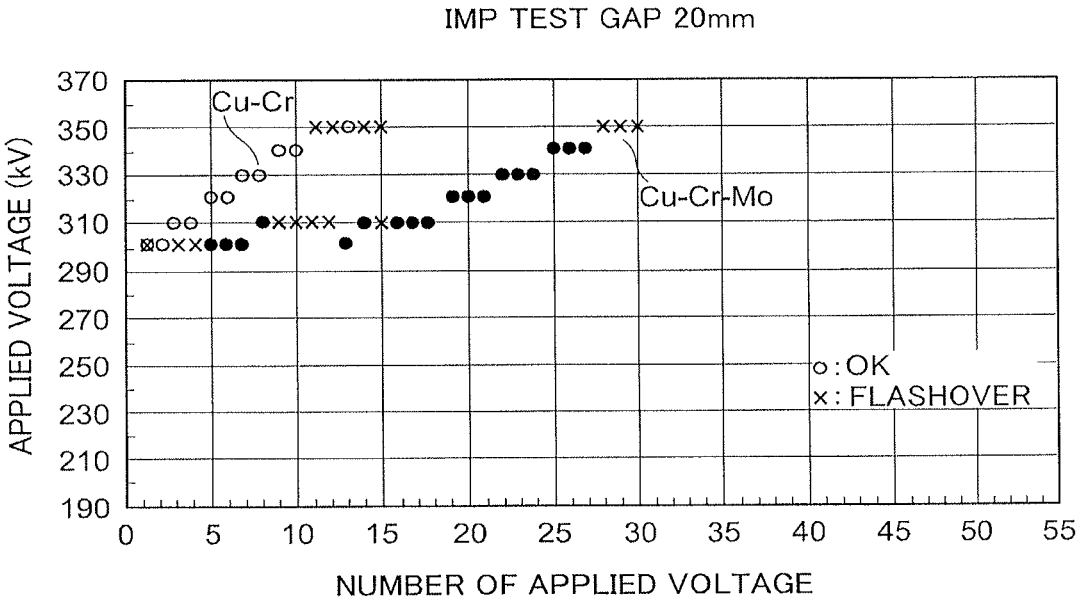
FIG. 8 is a chart that indicates the impulse voltage performance of the Cu—Cr material and the Cu—Cr—Mo material when the electrode separation of the electrode for vacuum circuit breaker is 20 mm.

The results of IMP tests, one with a gap of 12 mm and the other with a gap of 20 mm, are shown in FIG. 7 and FIG. 8 respectively. The Cu—Cr material, the performance of which is indicated by an open circle, does not cause flashover irrespectively of the gap distance until the testing voltage is significantly increased and the number of applied voltage is increased. This means that the material has sufficient withstand voltage performance voltage. On the other hand, the Cu—Cr—Mo material, the performance of which is indicated by a filled circle, causes flashover at a far lower test voltage than that of the Cu—Cr material and at a less number of applied voltage, indicating that the withstand voltage is low. From this, the Cu—Cr material, which is a high withstand voltage material, is used in such a portion of the contact plate 14 as is required to have a higher withstand voltage.

The contact plate 14 can be produced by a method for example wherein the outer peripheral member 21 formed in an annular shape using a sintered alloy and the central member 22 formed in a disk-like shape similarly using a sintered alloy are combined and silver brazed into a one-piece body. Or alternatively, it can be produced by a method using a metal mold wherein the outer periphery of the metal mold is filled with the Cu—Cr powder and the central part of the same is filled with the Cu—Cr—Mo powder and then filled powders are press-compacted and sintered to form a one-piece body.

In the electrode 10 of axial magnetic field type, the intensity of the electric field around the outer periphery of the contact plate 14 particularly in the area outside 80% of the diameter of the contact plate becomes high at the time of arcing as stated above. This causes the concentration of the electric field, which may develop easily into the re-ignition of arc. Therefore, the outer edge of the outer peripheral member 21 is beveled to a large extent as shown in FIG. 4 for relaxation of the concentration of electric field.

Since the above-stated configuration of the electrode 10 of axial magnetic field type is such that the center portion of the contact plate 14 is made of a central member of a high current interruption capable material, the use of such electrode improves the high current interruption performance and the capacitor switching performance. Further, since the outer peripheral member of a high withstand voltage material, which is highly compatible with the central member and has an excellent interruption performance, is used in the periphery where the electric field is intense, the withstand voltage performance is therefore more improved.

EMBODIMENT 3

Figure 5:
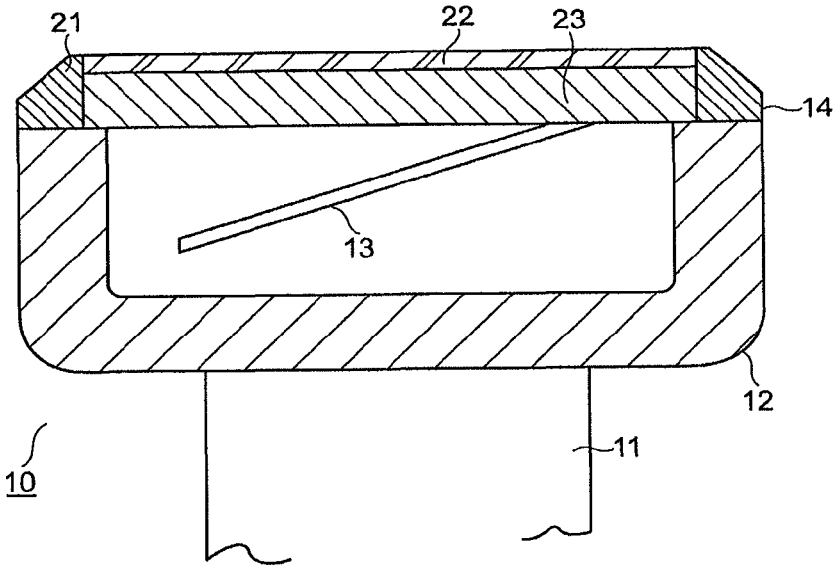
FIG. 5 is a schematic illustration of vertical cross sectional view of another embodiment of the electrode for vacuum circuit breaker by the present invention.

Next, an embodiment of the electrode for vacuum circuit breaker, which is another example of the present invention, is explained referring to FIG. 5. An electrode 10 of axial magnetic field type in the figure has a contact plate 14 comprised of a Cu—Cr outer peripheral member 21 having annular shape and a Cu—Cr—Mo central member 22, which are integrated into a one-piece body similarly to the example shown in FIG. 4. The central member 22 of the Cu—Cr—Mo sintered alloy, a high current interruption capable material, is given a different thickness.

As FIG. 5 shows, the thickness of the central member 22 of the Cu—Cr—Mo sintered alloy made of a high current interruption capable material is reduced and a circular-shaped copper plate 23 having a thickness equal to the decrement in such thickness reduction is used. The Cu—Cr—Mo material used in the central member 22 has a high resistance. Therefore, the member is preferred to be thin; a use with a thickness of 1 to 2 mm is realistic when an electrode consumption is taken into account. The annular-shaped Cu—Cr—Mo central member 22 of sintered alloy is arranged on the circular-shaped copper plate 23 and firmly fixed thereto, and the face thereof on the copper plate 23 side is firmly fixed to the cup-shaped contact member; other features are the same as those in the construction shown in FIG. 4.

EMBODIMENT 4

Figure 6:
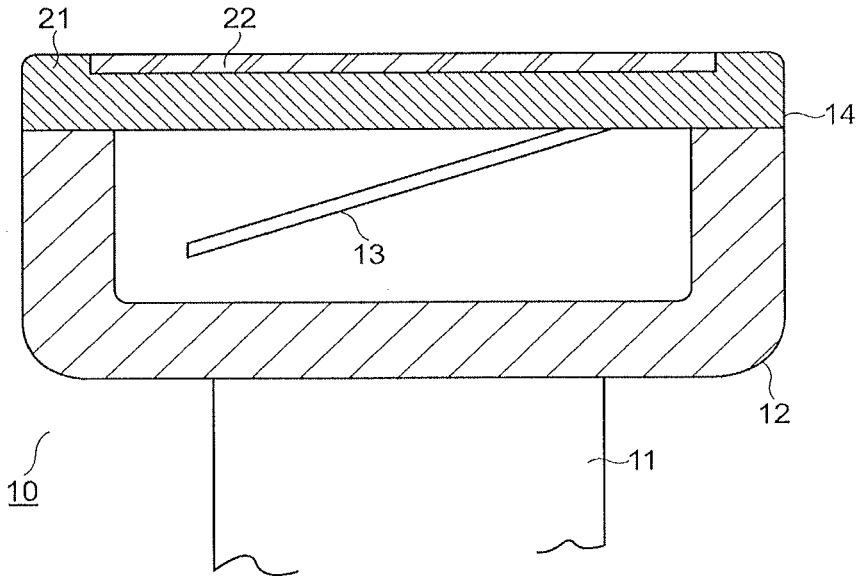
FIG. 6 is a schematic illustration of vertical cross sectional view of further another embodiment of the electrode for vacuum circuit breaker by the present invention.

An embodiment of the electrode for vacuum circuit breaker, which is further another example of the present invention, is explained referring to FIG. 6. In this example, an outer peripheral member 21 of a contact plate 14 of an electrode 10 of axial magnetic field type is formed in a disk-like shape having a hollow surface using a high withstand voltage material. In the recessed portion of the hollow surface on the outer peripheral member 21, a central member 22 produced using a sintered alloy having high current interruption capability is arranged to form a one-piece body.

When constructing the contact plate 14 using the Cu—Cr outer peripheral member 21 and the Cu—Cr—Mo central member 22 made of a sintered alloy, they can be produced separately followed by combining and firmly-fixing process. Instead, another producing steps are feasible, wherein the method is comprised of the steps: charging sintering alloy powder of high withstand voltage material in a mold, pressing the powder into a disk-like shape having a hollow surface, placing a sintered alloy of high current interruption capable material in the hollow surface and pressing them together, and sintering to form a one-piece body.

The electrode 10 thus configured as FIG. 6 shows can also attain the same effect as the examples stated above have. Further, when both the central member 22 and the Cu—Cr outer peripheral member 21 are produced using sintered alloy, it brings such an advantage that the contact plate 14 can be easily produced.

The present invention is useful because the invention is applicable not only to those vacuum circuit breakers explained in the embodiments stated above but also to those vacuum circuit breakers having other configuration.

The invention claimed is:

1. An electrode material for a vacuum circuit breaker, comprising:

a cup-shaped contact member fixed on an end face of a conductive rod; and a contact plate as an arcing portion, firmly fixed on an end face of said cup-shaped contact member, wherein the outer periphery of one end of said cup-shaped contact member has a plurality of slits that are slanted with respect to an axis forming an axial magnetic field type configuration, wherein said contact plate has an integrated one-body construction comprised of a central member and an outer peripheral member that is fixed firmly on the outer periphery of said central member, wherein said central member includes 30 to 50 wt % of Cu having a particle diameter of 20 to 150 μm and 50 to 70 wt % of Mo—Cr having a particle diameter of 1 to 5 μm and said outer peripheral member is a Cu—Cr material compatible with said central member.

2. The electrode material for vacuum circuit breaker according to claim 1, wherein said outer peripheral member is formed annularly using sintered alloy and said central member is formed in a disk shape using sintered alloy.

3. The electrode material for vacuum circuit breaker according to claim 2, wherein said central member has such a configuration that a circular copper plate is firmly fixed on said cup-shaped contact member side.

4. The electrode material for vacuum circuit breaker according to claim 1, said outer peripheral member is formed in a disk shape of hollow surface, and said central member is arranged in the recessed portion of the hollow surface of said outer peripheral member.

* * * * *